US008430530B2

(12) United States Patent
Aurongzeb et al.

(10) Patent No.: US 8,430,530 B2
(45) Date of Patent: Apr. 30, 2013

(54) CONFORMAL OLED LUMINAIRE WITH COLOR CONTROL

(75) Inventors: Deeder Aurongzeb, Mayfield Heights, OH (US); Thomas Alexander Knapp, Cleveland, OH (US)

(73) Assignee: General Electric Company, Schenectady, NY (US)

( * ) Notice: Subject to any disclaimer, the term of this patent is extended or adjusted under 35 U.S.C. 154(b) by 440 days.

(21) Appl. No.: 12/757,310

(22) Filed: Apr. 9, 2010

(65) Prior Publication Data

US 2011/0249425 A1 Oct. 13, 2011

(51) Int. Cl.
*F21S 4/00* (2006.01)

(52) U.S. Cl.
USPC ..... 362/249.04; 362/249.03; 362/84; 362/249.08; 362/414

(58) Field of Classification Search ..... 362/84, 362/249.03, 249.04, 249.07, 249.08
See application file for complete search history.

(56) References Cited

U.S. PATENT DOCUMENTS

| | | | | |
|---|---|---|---|---|
| 4,601,120 | A | 7/1986 | Levin | |
| 5,580,163 | A | 12/1996 | Johnson, II | |
| 5,752,766 | A | 5/1998 | Bailey | |
| 6,270,230 | B1 * | 8/2001 | Mai | 362/102 |
| 6,776,496 | B2 | 8/2004 | Cok | |
| 6,857,767 | B2 | 2/2005 | Matsui et al. | |
| 7,455,444 | B2 | 11/2008 | Chien | |
| 7,465,678 | B2 | 12/2008 | Bhattacharya et al. | |
| 2005/0110702 | A1 | 5/2005 | Aoki | |
| 2006/0083004 | A1 | 4/2006 | Cok | |
| 2006/0232524 | A1 | 10/2006 | Cok | |
| 2006/0285361 | A1 | 12/2006 | Cok | |
| 2007/0262916 | A1 | 11/2007 | Kee et al. | |
| 2010/0045189 | A1 | 2/2010 | Storch et al. | |
| 2010/0046210 | A1 | 2/2010 | Mathai | |

FOREIGN PATENT DOCUMENTS

| | | | |
|---|---|---|---|
| DE | 29913930 | U1 | 11/1999 |
| DE | 10102613 | A1 | 7/2002 |
| DE | 102005003633 | A1 | 8/2006 |
| EP | 1783532 | A1 | 5/2007 |
| WO | 2007/094810 | A2 | 8/2007 |
| WO | WO 2008/005610 | A1 | 1/2008 |
| WO | 2008/060469 | A2 | 5/2008 |
| WO | 2010/004073 | A1 | 1/2010 |

OTHER PUBLICATIONS

PCT Invitation to Pay Additional Fees issued in connection with corresponding WO Patent Application No. US2011/028054 filed on Mar. 11, 2011.

PCT Search Report and Written Opinion dated Feb. 16, 2012 from corresponding Application No. PCT/US2011/028054.

* cited by examiner

*Primary Examiner* — Ali Alavi
(74) *Attorney, Agent, or Firm* — Fay Sharpe LLP

(57) ABSTRACT

A luminaire, such as a lamp assembly or a floor lamp, umbrella, or planar or sheet-like like light emitting surface includes a conforming mechanism for selectively curving the light emitting surface. A convex profile will diffuse light while a concave profile will concentrate light, it being intended that the surface can be conformable up to a five inch (5") radius of curvature in either direction. The light panel portions may be of the same color, or may be different colors that will result in different mixing of the light when made from different colors.

25 Claims, 14 Drawing Sheets

CONFORMAL OLED LUMINAIRE WITH COLOR CONTROL

BACKGROUND OF THE DISCLOSURE

This disclosure is directed to a luminaire, and more particularly to a luminaire that uses a flexible surface light source such as solid state light source, particularly an organic light emitting device (OLED). Specifically, use of a solid state light source such as a light emitting device (LED) or an OLED offers a wide range of different applications.

Recent developments with both LED and OLED light sources have come to fruition. As the lumen output of these structures has improved, there is a continuing need to develop new products and markets. Control of the light output is an important consideration, as well as color uniformity and color control. Further, simplified structures and applications that can advantageously use selected aspects of a solid state light source present new challenges with regard to function and cost. Consequently, a need exists to incorporate these design considerations into different lamp assemblies.

SUMMARY OF THE DISCLOSURE

A luminaire includes a flexible surface on which a solid state light emitting device is mounted. In one embodiment, the light emitting device includes at least first and second panel portions. A conforming mechanism is associated with the first panel portion to conform the first and second panel portions relative to one another.

In a preferred arrangement, the first panel portion is capable of being conformed or curved up to a five inch (5") radius of curvature.

In one exemplary embodiment, the first and second solid state light emitting devices include a light emitting diode, and more preferably multiple LEDs, enclosed by a translucent housing.

In another arrangement, the first and second solid state light emitting devices include an OLED.

A preferred conforming mechanism includes a threaded member for selectively altering a curvature of at least the first light emitting device.

The first color panel portion is centrally positioned between second panel portions of a different color on either end. In one arrangement, the first color panel portion emits blue light and the second panel portion emits yellow light.

The flexible surface may be an umbrella in which OLED portions are mounted on interior panels of the umbrella.

In another luminaire, perimeter portions of the flexible surface are supported and an adjustable member supports a central portion of the flexible surface for selectively advancing and retracting the central region relative to the perimeter through positive and negative curvatures.

A primary benefit of this disclosure is the provision of a device with light directing capability.

Another feature of the present disclosure relates to the ability to mix colors emitted from a flexible surface.

Still another advantage resides in the ability to focus or diffuse the light emitted from the flexible surface.

Still other benefits and advantages of the present disclosure will become more apparent from reading and understanding the following detailed description.

DETAILED DESCRIPTION OF THE PREFERRED EMBODIMENTS

Figure 2:
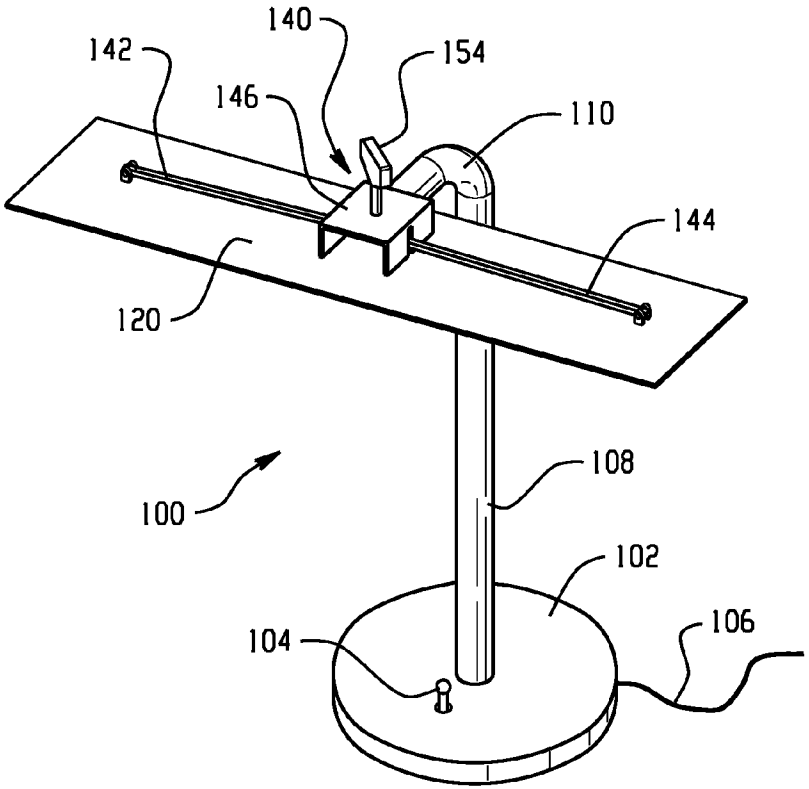
FIG. 2 is a top perspective view of the luminaire of FIG. 1.
Figure 1:
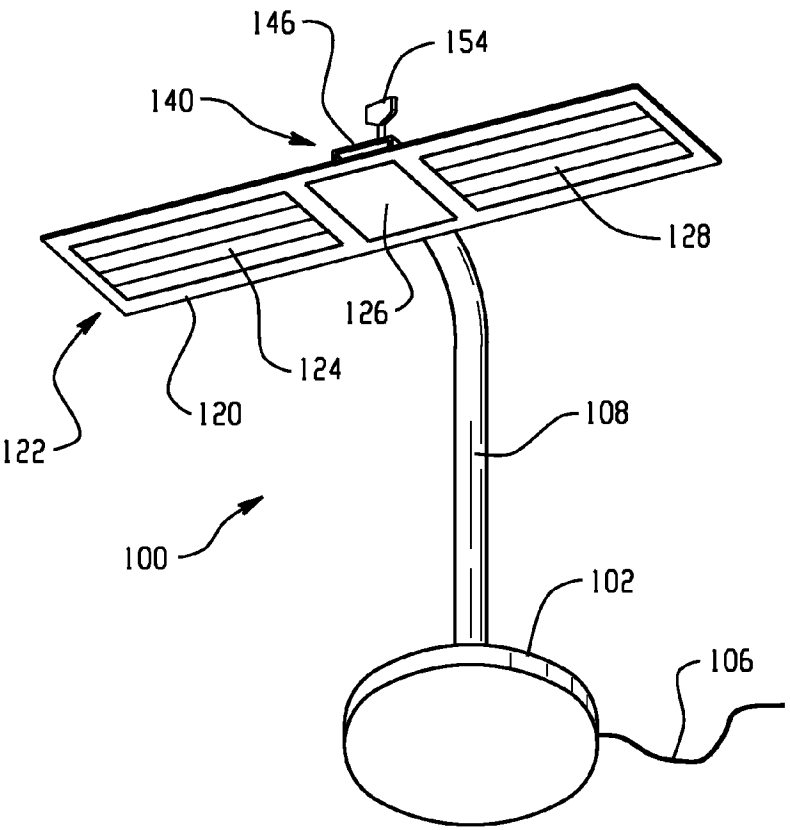
FIG. 1 is a perspective view of a luminaire or lamp assembly incorporating at least one flexible light source.
Figure 3:
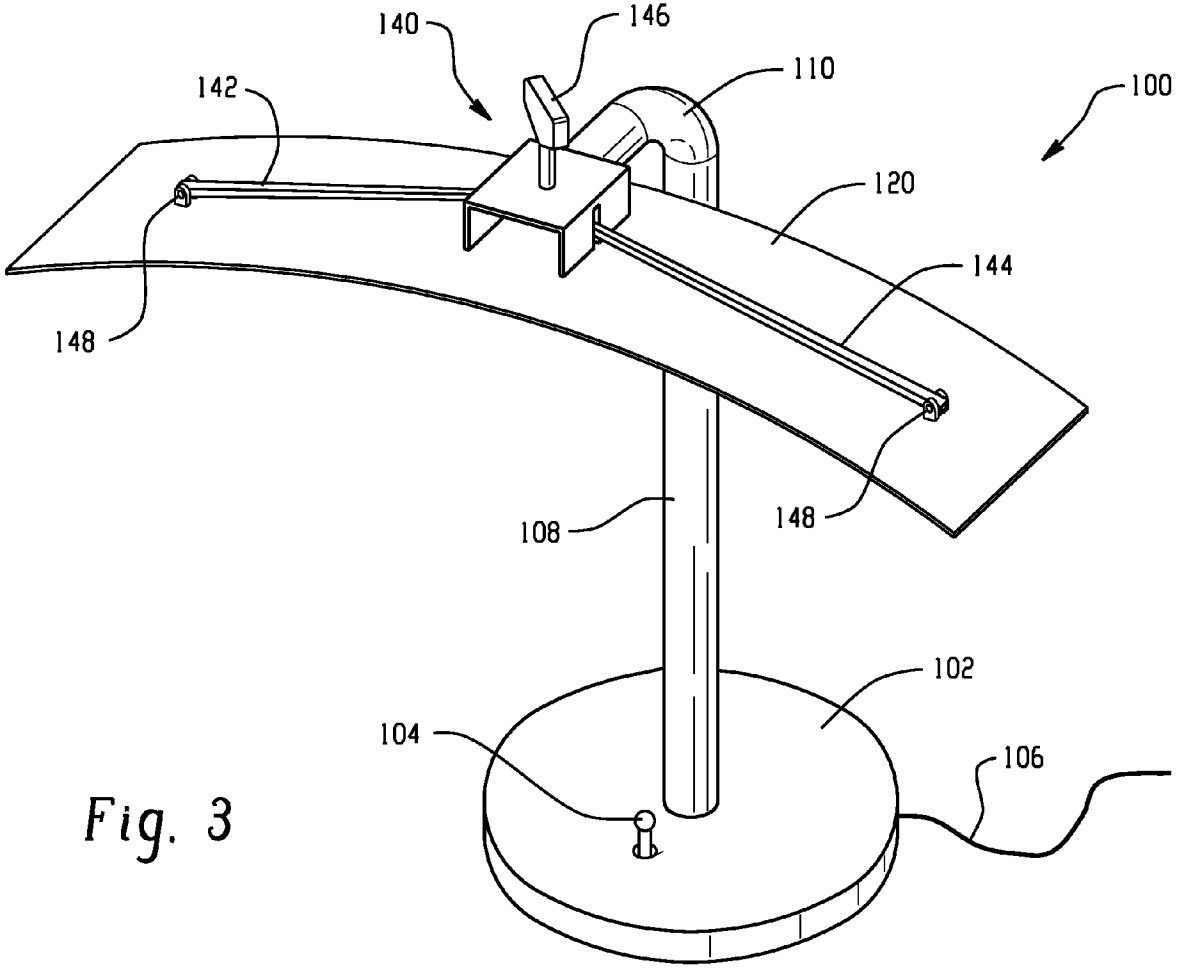
FIG. 3 is a perspective view similar to FIG. 2 illustrating a concave curvature of the conformal lamp.
Figure 5:
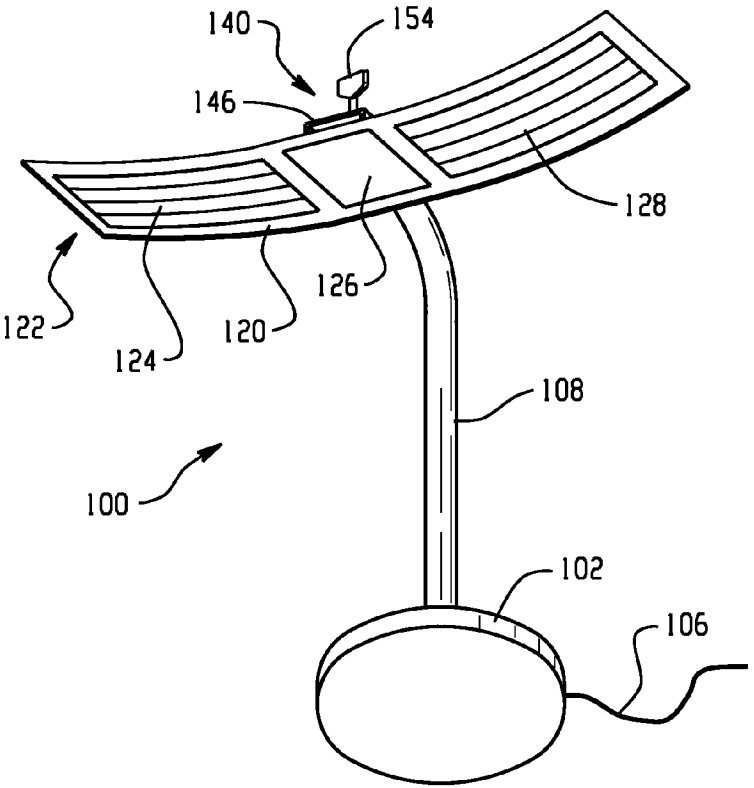
FIG. 5 is a view similar to FIG. 4 and illustrating a convex curvature of the conformal lamp.
Figure 4:
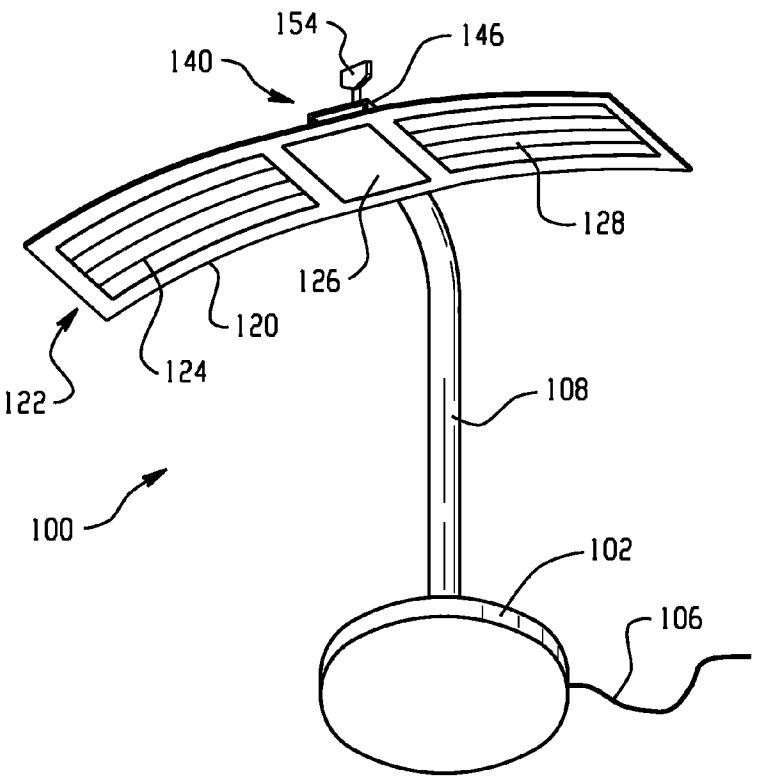
FIG. 4 is a perspective view of the lamp of FIG. 3 generally illustrated from the underside.
Figure 6:
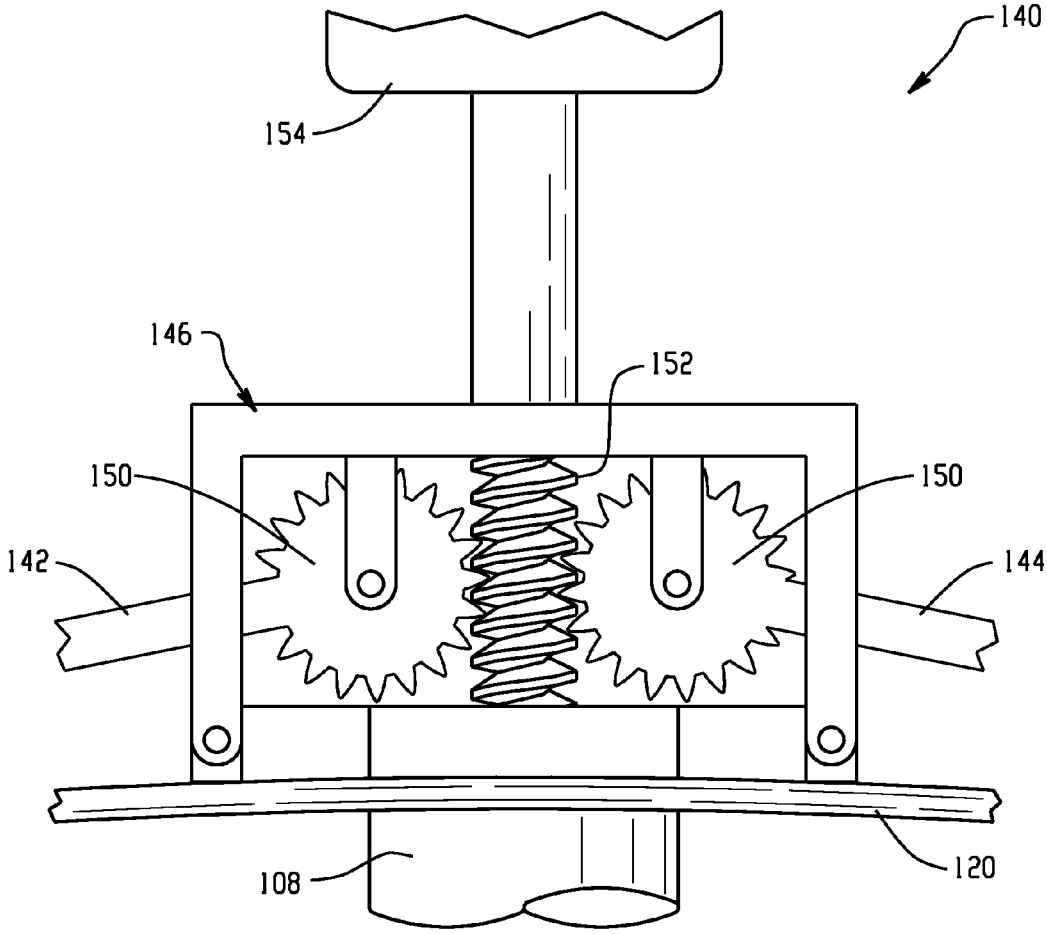
FIG. 6 is an enlarged view of the conforming mechanism.

FIGS. 1-6 illustrate a first preferred embodiment of a luminaire or lamp assembly 100. In this exemplary embodiment, the lamp assembly 100 includes a rigid base 102 having an ON/OFF switch 104 or the ON/OFF switch could also be incorporated in to the power supply cord 106. Extending from the base is a support or neck 108 which in the preferred arrangement is a rigid structure that is generally elongated and extends vertically above the base and is turned at an upper end 110. The upper end supports an elongated panel 120 formed of a thin material that is rigid with regard to its own weight and its rated load, but which can be conformed with an external force applied thereto. The panel preferably carries a solid state light emitting device 122. In the illustrated embodiment of FIGS. 1-6, the light emitting device is intended for a small area of illumination, that is, on the order of less than one hundred square feet (100 $ft^2$) per four (4) watt device by using flexible solid state panels such as OLED panels with greater than five (5) lux illumination. Multiple, flexible OLED panel portions 124, 126, 128 are shown in this embodiment. Each of these panel portions comprises OLED devices where each panel includes a first electrode and a second electrode which can be connected and powered in series, for example where there are three or less panels, or can be connected and powered individually, or in series/parallel mode for panels comprised of four or greater OLED portions. In the illustrated embodiment, the first and third panel portions 124, 128 preferably emit light of a first color, for example yellow light, while the second or central panel portion 126 emits a different color light, such as blue light. In order to have a flexible operation and provide a radius of curvature on the order of about five inches (5 in), an aspect ratio is from 1.0 to 1.8 with a thickness of less than five hundred micrometers (500 μm). The total illuminating panel comprised of the three OLED panel portions may be on the order of approximately eighteen inches (18") in length and approximately four inches (4") in width. Due to its flexible operation, the thickness must be less than one millimeter (1 mm) per one square meter (1 $m^2$) in order to reduce the potential for cracking in the device. Further, to reduce visible differentiation, the device can be covered with a diffuser material such as a fifty percent (50%) alumina, twenty percent (20%) titanium dioxide ($TiO_2$) and thirty percent (30%) $(LaMg)_3(PO_4)_2$ material, or a more preferable mixture is a titanium dioxide/alumina particle.

The blue emitting panel portion 126 is preferably located in a central region to form a high color illumination area at the center. Further, the light level of the blue device allows for CCT control, i.e., color control from approximately 3,000K to 7,000K. On a surface of the panel 120 opposite that of the light emitting devices 122 is provided a conforming mechanism 140. By "conforming" is meant imparting a smoothly contoured, generally continuous shape, arc, or curvature to the panel portion. Conforming is contrasted with "bending", for example, which is deemed to be imparting a sharp crease, angle, or fold to the panel portion. The conforming mechanism imparts curving over the length of the panel, for example, first and second arms 142, 144 extend from a central actuator 146. The outer or distal ends of each arm 142, 144 are pivotally mounted to the panel via pins 148, while the proximal or inner ends of the aims include a spur gear 150 that engages with a worm gear 152. Selective rotation of the worm gear imparts rotary motion to the spur gears which are moved toward and away from the rotational axis of the central worm gear in response to the actuation or rotation. The direction of rotation of the worn gear 152 via actuating handle or key 154 extends or retracts the first and second arms to impart a curvature to the elongated panel. Alternatively, rather than a manual control of this rotation, a motor may be used to impart such actuation to the elongated flexible panel.

Figure 8:
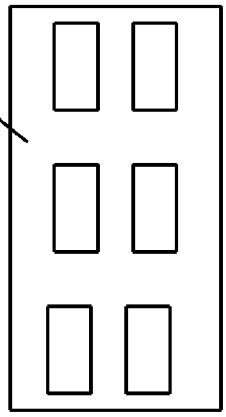
FIG. 8 is a view of a blue OLED.
Figure 9:
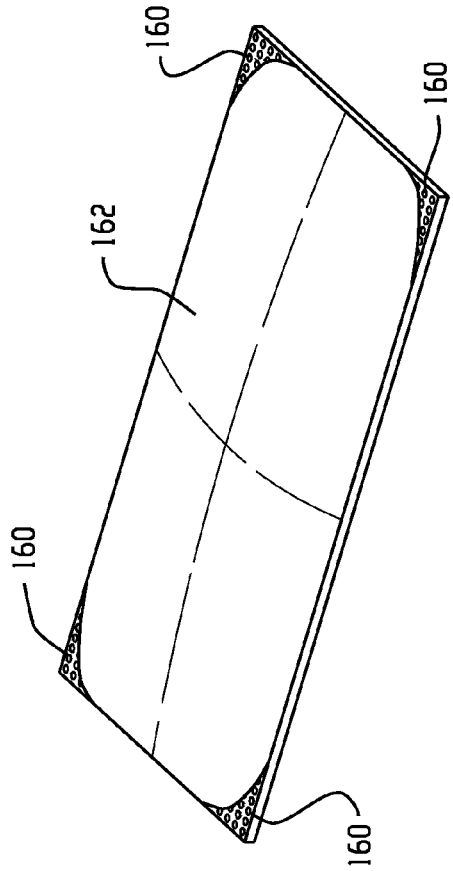
FIG. 9 is an enlarged view of the LED Portion of the lamp of FIG. 7.
Figure 7:
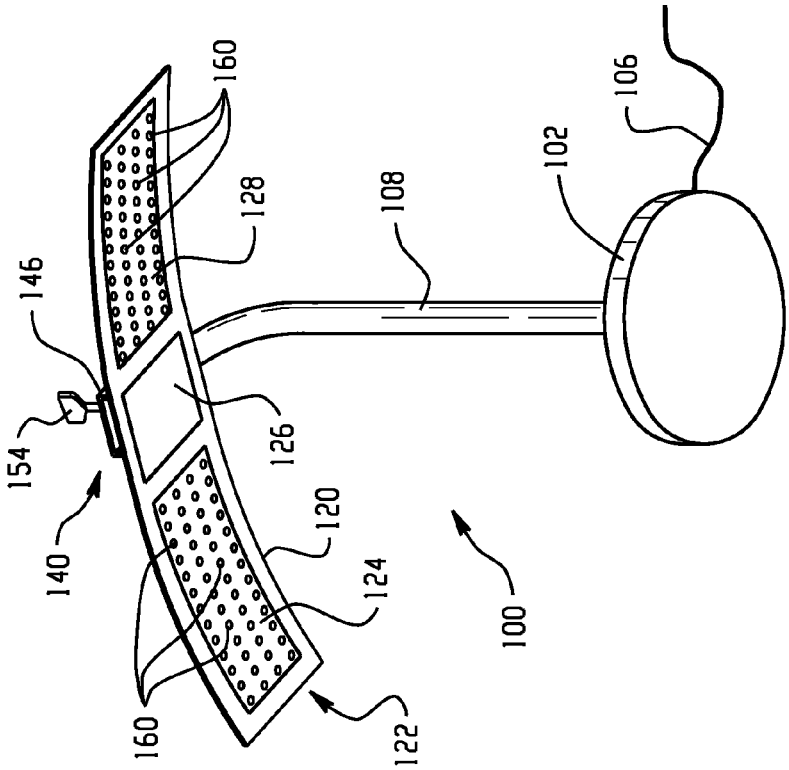
FIG. 7 is a perspective view of a conformal lamp using LEDs.

With continued reference to FIGS. 1-6, and additional reference to another preferred embodiment of FIGS. 7-9, many of the same components will be identified by the same reference numerals, and where differences occur, new reference numerals are used. For example, the first and third panel portions 124, 128 are still disposed outwardly from a central panel portion which is preferably a blue OLED. The first and third panel portions, however, may be formed from individual light emitting devices or LED disposed in spaced relation over the panel portions where the individual LEDs 160 emit light which is then diffused by a cover or dome 162. The dome or translucent/transparent cover has a coating such as a phosphor for diffusing and emitting light over the entire surface of the dome rather than as individual point sources. Again, the first and third panel portions 124, 128 may be same color, which in a preferred arrangement is different from the second or central panel portion 126. It will also be recognized that with the embodiments of either FIGS. 1-6 or FIGS. 7-9, the direction of rotation of the actuator will control whether the panel 120, and particularly outer wing portions thereof, undertake a planar, convex, or concave conformation. The concave profile shown in FIGS. 3 and 4 tends to concentrate light inward toward a remote location, while the convex profile of FIG. 5 diffuses light outwardly. Preferably, the wings are conformable up to a five inch (5") radius of curvature in both directions.

Moreover, using different colored light sources on the elongated end panels that are different from the central panel can control color mixing. For instance, a blue light source in the central panel portion 126 and yellow light sources in the first and third light panel portions 124, 128 will mix differently based on the degree of curvature of the panel.

Figure 10:
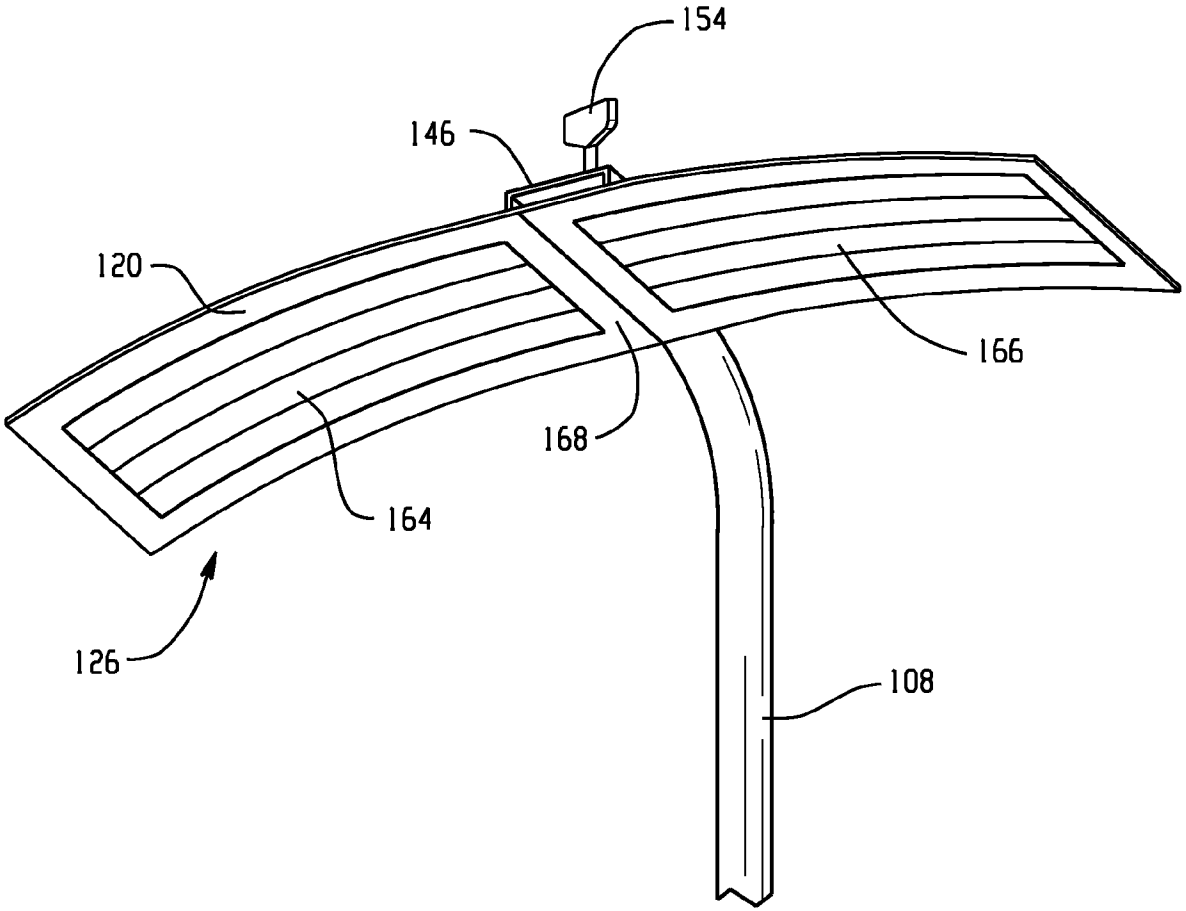
FIG. 10 is a perspective view with first and second flexible lamp portions of the same color shown in a concave curvature.

FIG. 10 is still another embodiment of the flexible luminaire or lamp assembly. Again, like reference numerals will refer to like components. The primary distinction is the elimination of a second panel portion of a different color. Thus, in this particular arrangement first and second end panel portions 164, 166 are preferably the same color and separated by a perimeter frame 168 associated with the individual solid state light emitting devices. Nevertheless, the ability to impart a convex or concave conformation to the elongated panel 120 via the conforming mechanism 140 allows for the ability to concentrate light inwardly in the concave profile as shown in FIG. 10, or to diffuse light outwards if a convex profile (similar to FIG. 5) is adopted.

Figure 11:
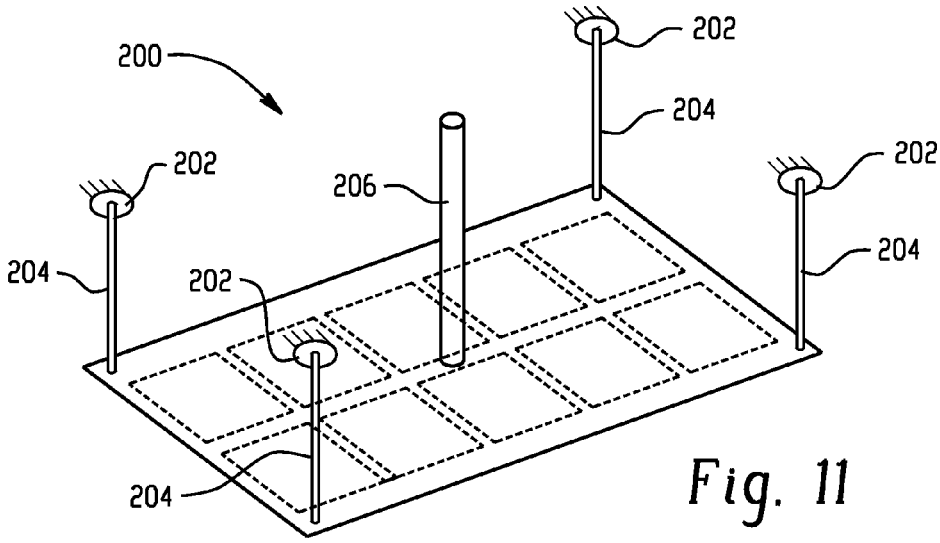
FIG. 11 is a perspective view of a large panel OLED suspended from a stationary structure such as a ceiling.
Figure 12:
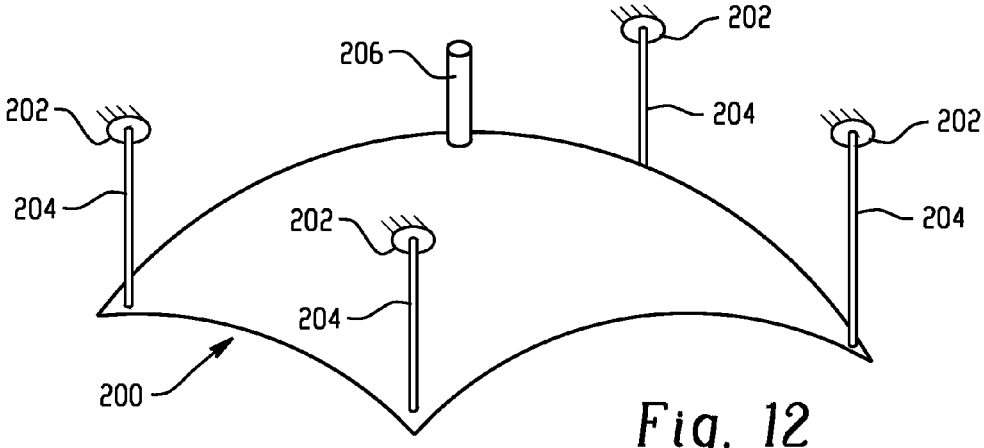
FIG. 12 shows the large panel OLED of FIG. 11 in a concave configuration.
Figure 13:
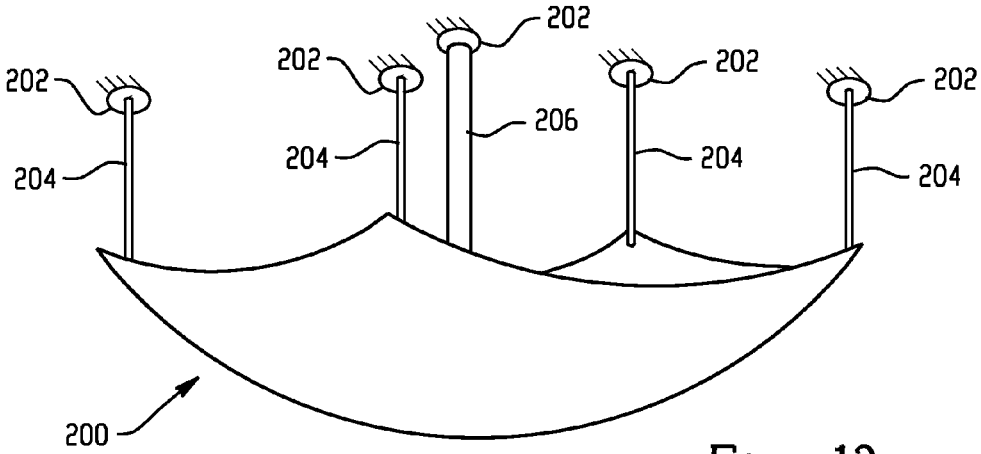
FIG. 13 shows the large panel OLED in a convex configuration.

FIGS. 11-13 illustrate an OLED large panel 200, shown suspended from a fixed structure such as a ceiling 202. Again, the solid state light emitting device is a large panel and may be comprised of multiple OLED panels tiled or joined together in an array such as the rectangular configuration of the OLED panel 200. Here, different panel portions may be the same color or may be alternate colors. In this arrangement, one portion of the panel is rigidly secured, here, being suspended via first supports or support members 204. These first support members 204 are preferably non-adjustable. The first support members may be rigid members, or flexible wires that are extended to their full length to carry the weight of the OLED suspended from the ceiling. In this particular arrangement, the first support members support a first portion of the flexible surface, namely, a perimeter portion of the OLED panel. A second or adjustable member(s) 206 supports a second portion of the flexible surface. Here, the second, adjustable member 206 extends between the ceiling 202 and the central portion of the flexible surface. In this manner, selected extension and retraction of the adjustable support(s) 206 conforms the OLED panel into a concave conformation (FIG. 12) when the adjustable support is retracted or conforms to a convex shape as shown in FIG. 13 when the adjustable support is extended. Thus, the embodiment of FIGS. 11-13 illustrates a relatively simple configuration of a single convex or concave shape, although one skilled in the art will appreciate that different arrangements of non-adjustable support members and/or adjustable support members would allow alternative or more complex geometries to be achieved.

Figure 15:
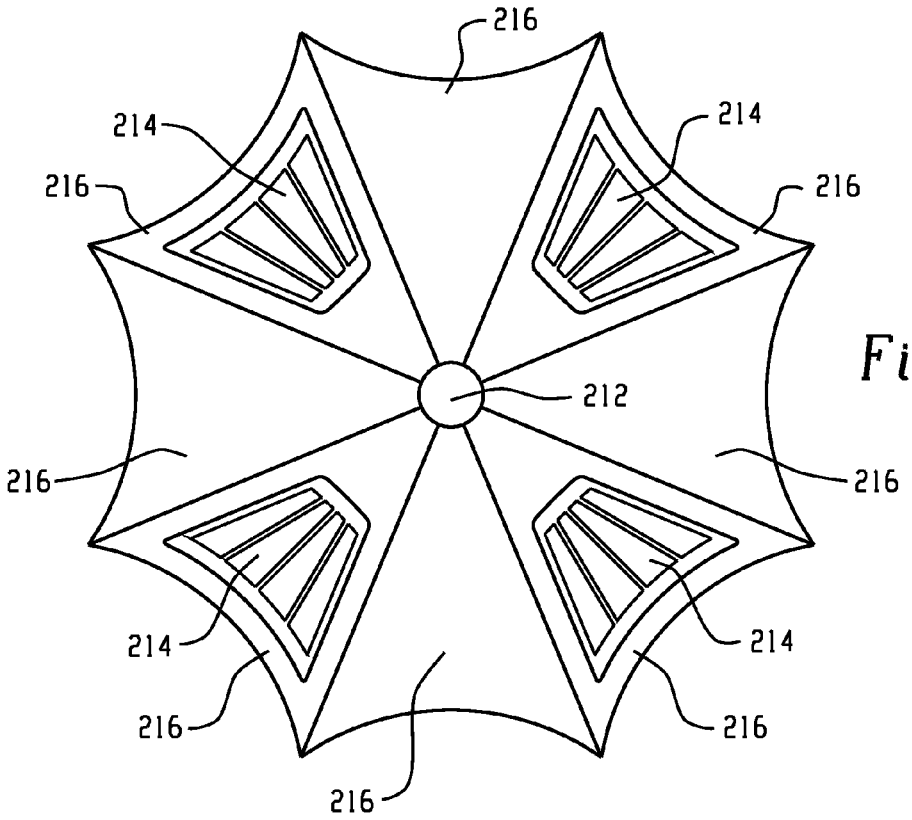
FIG. 15 is a bottom view of the open umbrella of FIG. 14 more particularly illustrating location of light emitting panels.
Figure 14:
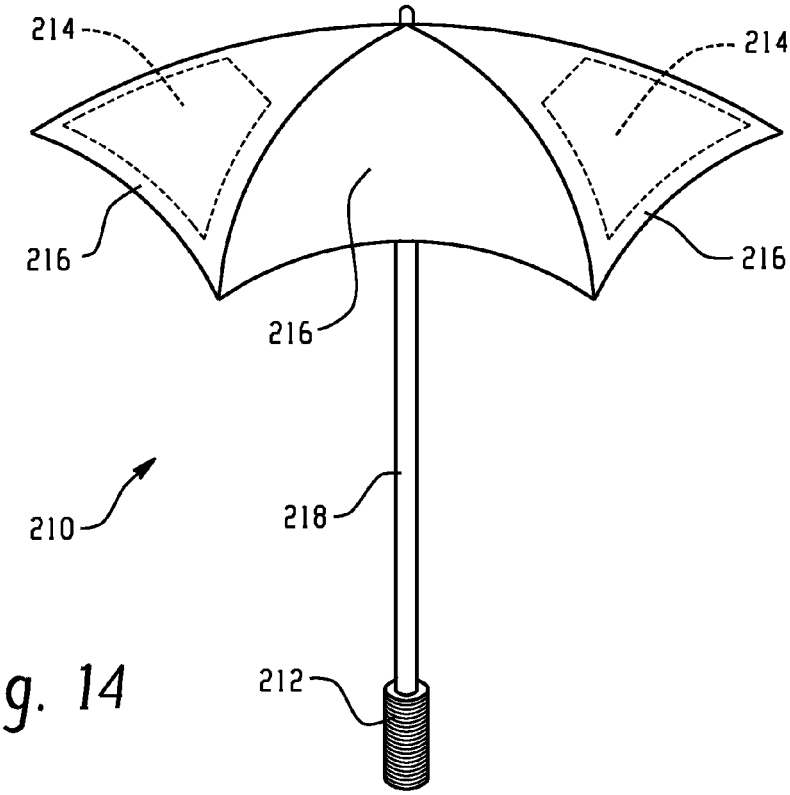
FIG. 14 is a front view of an umbrella incorporating flexible light emitting panels.

The embodiment of FIGS. 14 and 15 shows an umbrella 210. The handle 212 may include a battery or similar portable power device that is used to power individual flexible light panel portions or light surfaces 214 disposed in segments 216 on the umbrella surface. Particularly, the flexible light panel portions are located on the interior portions of the umbrella and are shown here as being located in every other flexible segment of the interior of the umbrella. Of course, this need not be the case, and a greater or lesser number of segments or portions of the umbrella segments may be used without departing from the scope and intent of the present disclosure.

Figure 16:
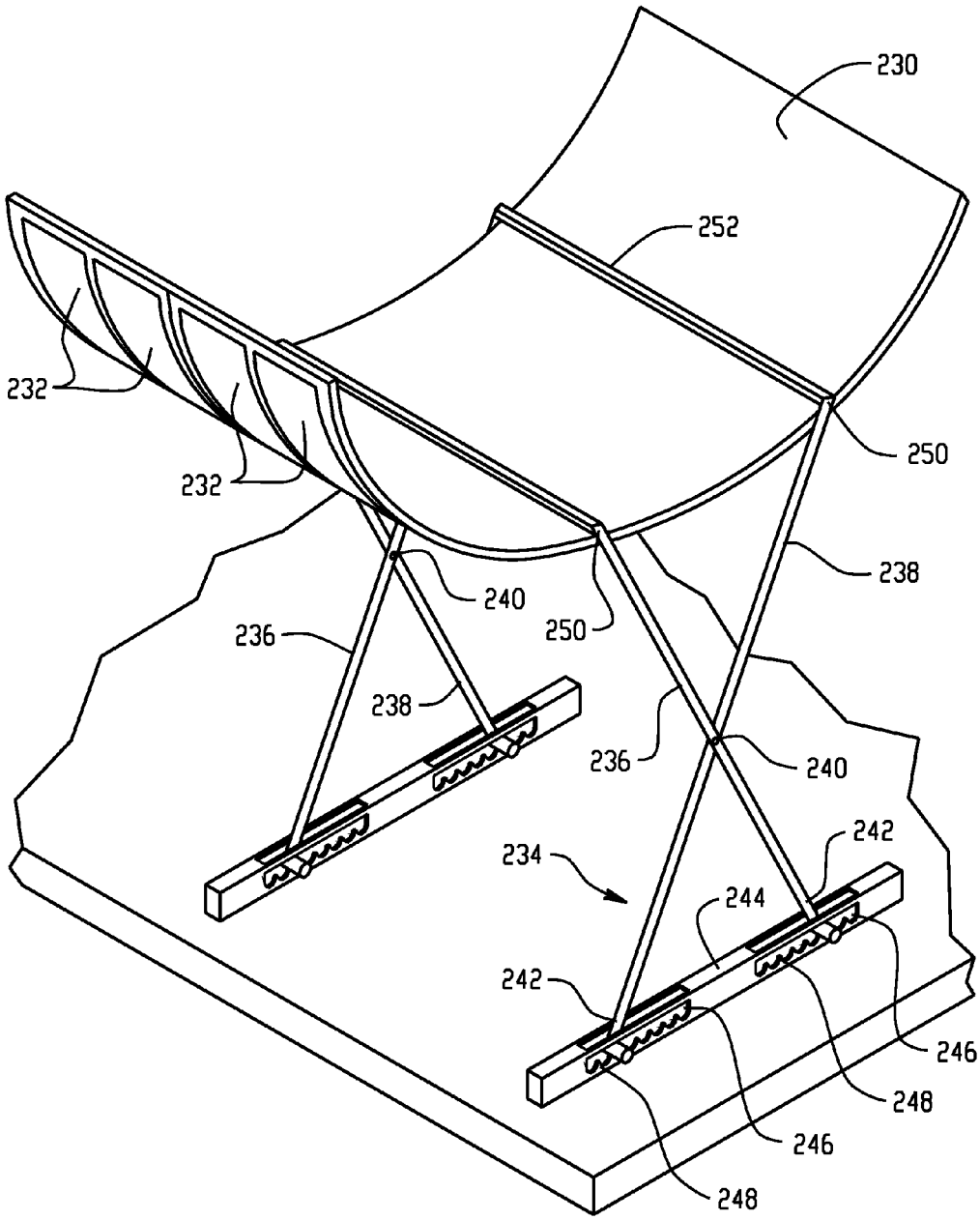
FIG. 16 is a perspective view of an alternate free standing lamp assembly that has a predetermined curvature that may be selectively altered by the support legs.

In FIG. 16, a panel 230 includes solid state light emitting devices 232 such as OLEDs to emit light from at least one surface of the panel. In this arrangement, the panel has a predetermined curvature, i.e., when viewed from the floor as illustrated in FIG. 16, the panel has a generally convex contour. An adjustable support 234 is provided to alter the curvature of the panel. For example, first and second adjustable support members 236, 238 are pivotally joined together in central region 240 to form an adjustable generally "x-shape" support. First or lower ends 242 of each of the support members 236, 238 are received in a base 244 that includes slots 246, one slot preferably for each of the lower ends 242, and in which each slot has segmented, spaced stops 248 that allow each leg to be individually moved relative to the base, and engage against a new or different stop. This allows the light emitting surface 232 to be tilted, and also allows the curvature of the panel to be altered. For example, if the dimension between the lower ends 242 is increased, then the curvature at the second or upper ends 250 will likewise be increased and spanning members 252 will likewise be spread apart. This reduces the curvature of the panel. In similar fashion, when the first ends 242 are brought closer to one another, then the second ends 252 likewise are brought closer together and the predetermined conformation of the panel allows the curvature to increase, i.e., become more convex. If one of the legs on each side is maintained against the same stop in the base while the position of the lower end of the other leg is altered, the curvature not only changes, but the tilt or angle of the panel. Consequently, the contour and angle of the light emitting surface will also be altered.

Figure 17:
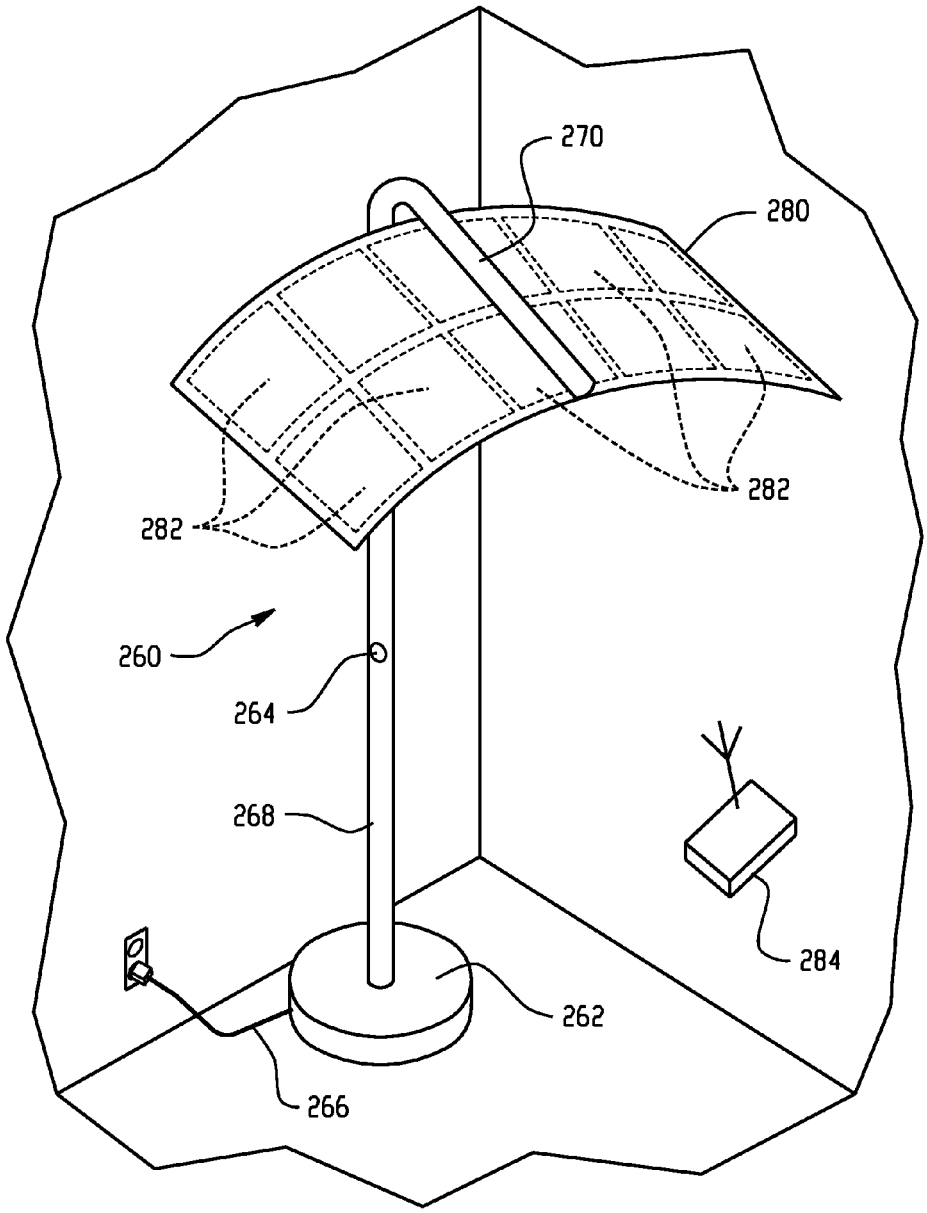
FIG. 17 is a perspective view of a floor lamp using the OLED large panel.
Figure 18:
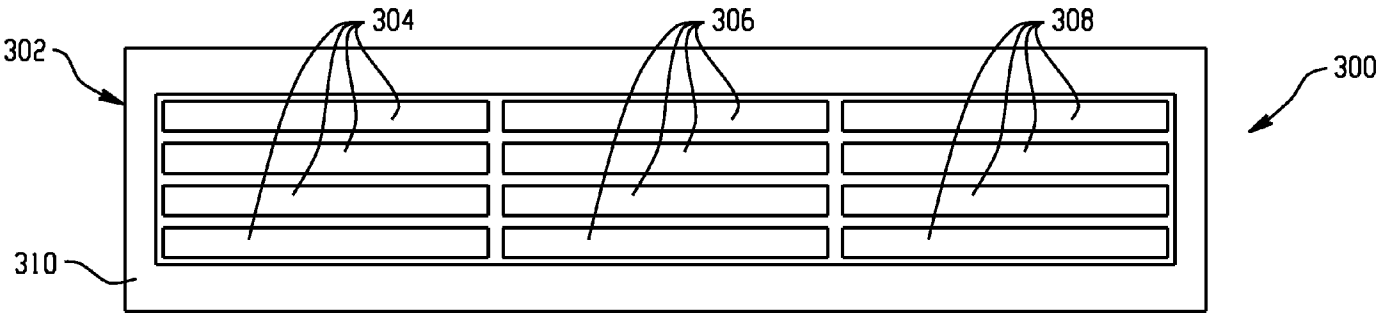
FIG. 18 is a plan view of an OLED panel in another preferred embodiment.
Figure 19:
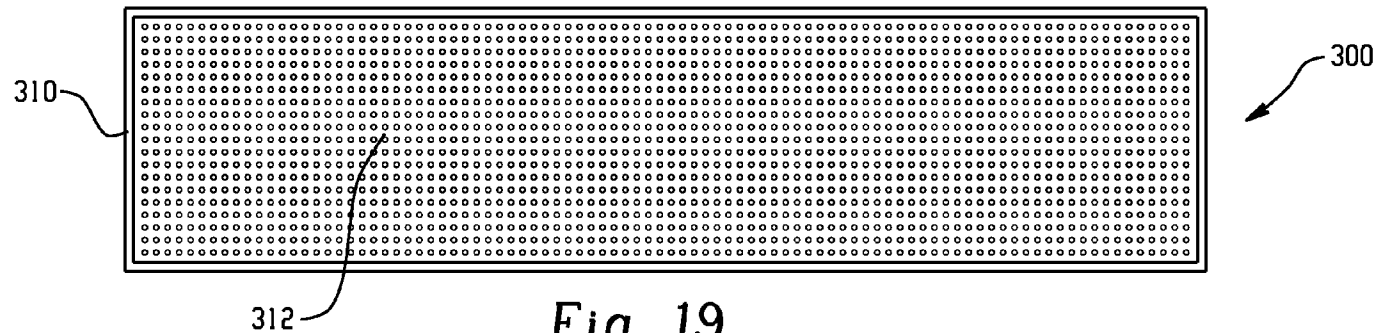
FIG. 19 is a plan view of the OLED panel of FIG. 18 with a diffuser plate received over the OLED panel.
Figure 20:
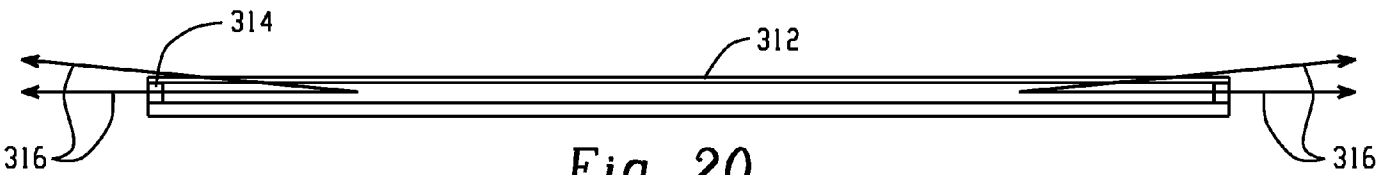
FIG. 20 is a front view of the OLED panel and diffuser plate assembly of FIGS. 18 and 19.
Figure 21:
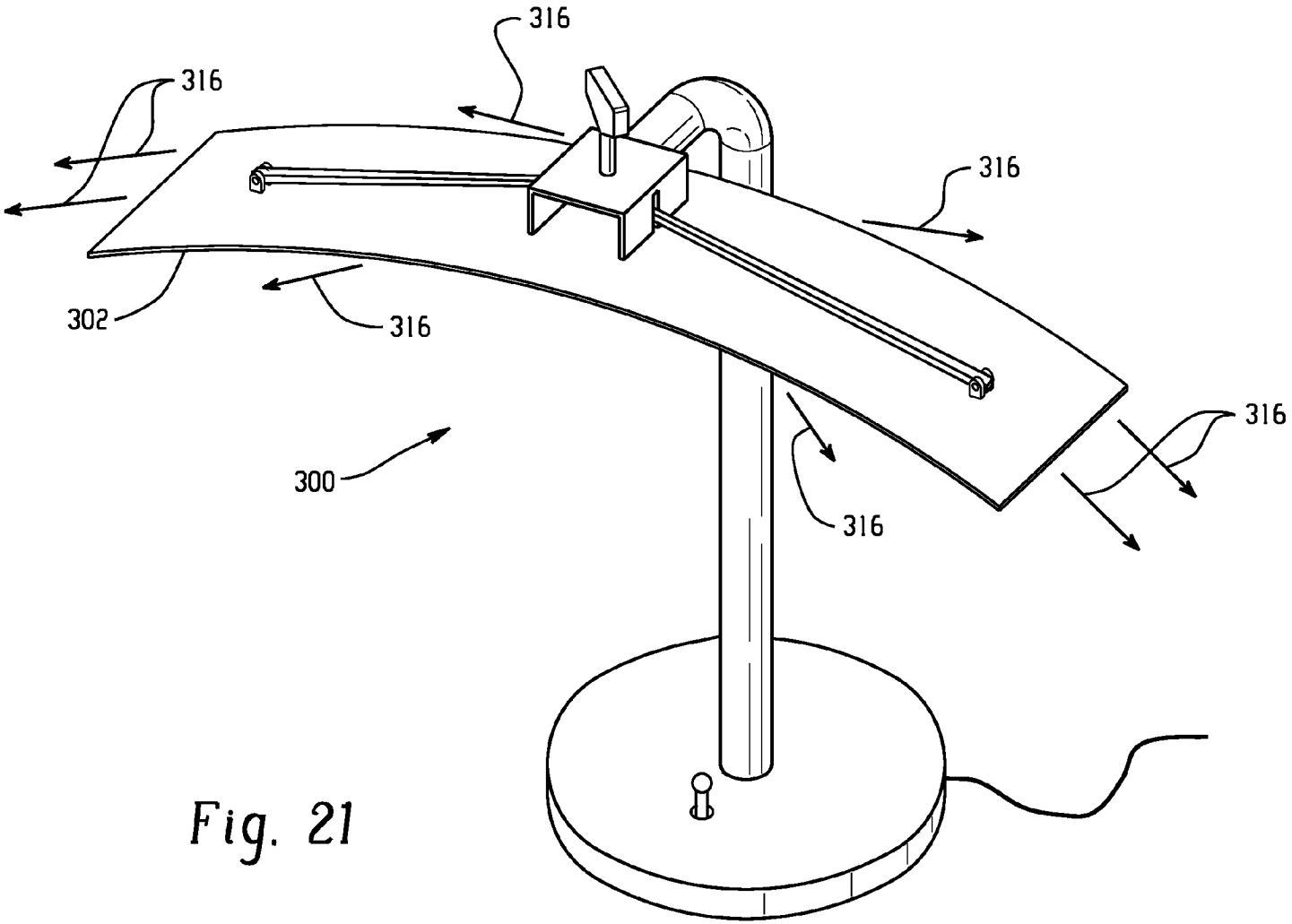
FIG. 21 illustrates light output from a desk lamp employing the OLED panel and diffuser plate assembly of FIGS. 18-20.

FIG. 17 demonstrates a floor lamp 260 that includes a base 262, ON/OFF switch 264, power supply cord 266, and an elongated support 268 that includes a bent over upper end 270. A larger panel 280 would likely use a larger matrix of individual light sources or OLED devices. Additionally, if a motor were implemented to control formability of the panel and light emitting surface thereof, a remote control 284 could be used to control the motor and likewise turn the lamp on and off. Further, the remote control could be used for dimming of the lamp.

An exemplary desk or portable lamp includes a blue OLED having a light emitting surface area of approximately three square inches and two rectangular yellow OLEDs disposed on opposite sides of the blue OLED, where each yellow OLED has three light emitting surface areas that are approximately three-six square inches in surface area and each totaling approximately eighteen square inches as shown in FIGS. 1-6. The total power for this lamp was less than 2.5 W. The color tuning was achieved from 3500K to 5600K by tuning or adjusting the power level of the blue OLED from about twenty percent (20%) of the power to one hundred percent (100%) of the power to a spot at a distance less than about three feet. The luminaire emits about fitly to one hundred fifty lumens at its maximum efficiency. Optionally, an outcoupling film could be used to focus light in a forward direction where one preferred type of outcoupling film is sold by 3M under the tradename BEF2 or BEF3. Although in the exemplary embodiment the OLED devices were driven with a DC power supply in series, it will be understood that the devices could also be driven individually. Parallel driving of the OLED devices is typically not preferred.

Shown in FIGS. 18-21 is another preferred embodiment of a flexible luminaire that has many of the characteristics of previous embodiments. In this arrangement, luminaire 300 includes an elongated, thin, generally rectangular large area panel 302 (for example, on the order of 10 cm×100 cm, or 20 cm×100 cm). In the same manner as described in the prior embodiments, OLEDs 304, 306, 308 may be a single color or different colors, and by forming the OLED panel 302 and accompanying support structure 310 as thin layers, flexibility of the entire assembly may be achieved. Here, a diffuser plate 312 preferably extends in closely spaced relation over the OLEDs and is supported along a perimeter edge 314 from the OLEDs. By way of example only, the diffuser plate 312 has a thickness less than 2 mm and is spaced from the OLEDs by a dimension that ranges from approximately 4 mm to 10 mm. On the other hand, in other embodiments the diffuser plate has a thickness greater than 2 mm and may be in direct contact with the OLED panel, however, this arrangement is slightly less efficient. In either case, the diffuser plate provides edge lighting as represented by the light ray traces 316 in FIGS. 20 and 21.

Figure 22:
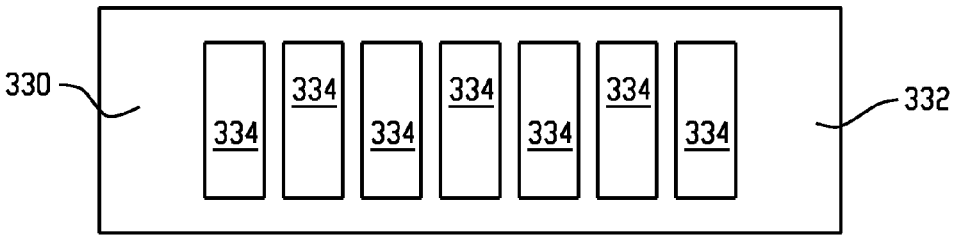
FIGS. 22-24 are plan views of various locations of the OLED panel.
Figure 23:
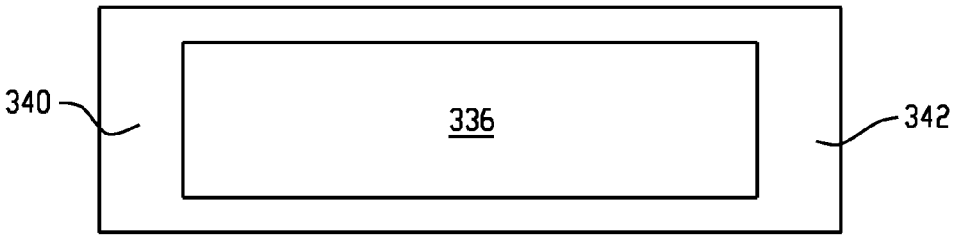
Figure 24:
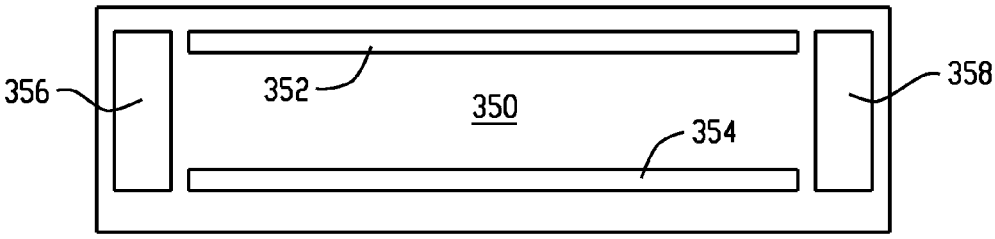
Figure 25:
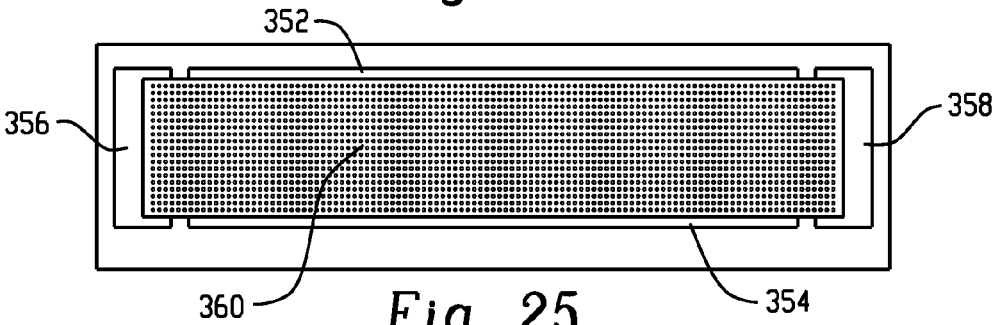
FIGS. 25 and 26 are plan views of the OLED panel with light piped in to illuminate at least a portion of the panel.
Figure 26:
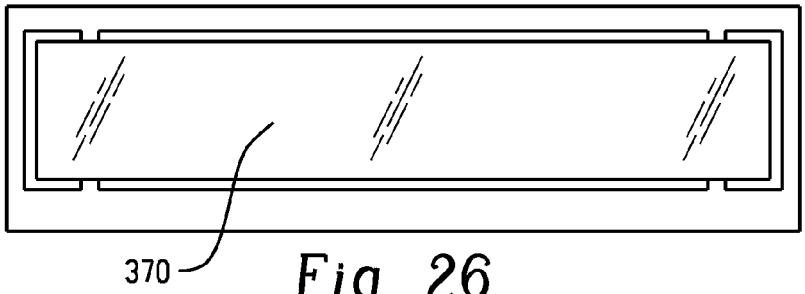

FIGS. 22-26 disclose variations of above-described concepts such as alternative locations of the OLEDs in the light emitting surface of the panel. In FIG. 22, end portions 330, 332 of the generally rectangular panel do not include any OLEDs, and instead the multiple OLEDs 334 are disposed along a central portion of the geometric shape of the panel. Similarly, the embodiment of FIG. 23 also locates a single large OLED or light emitting portion 336 of the panel in a central region and the end portions 340, 342 are devoid of any light emitting surface. In the exemplary embodiment of FIG. 24, though, central portion 350 does not include a light emitting member and instead the perimeter portions include elongated light emitting regions 352, 354 adjacent two edges and light emitting end regions 356, 358. FIG. 25 adds to the arrangement of FIG. 24 by including additional light from associated fiber optics (not shown) that illuminate all or some of an area of the flexible panel that includes a diffuser 360. Similarly, the exemplary embodiment of FIG. 26 uses a lens 370 or high index of refraction material such as glass to aid in directing light to a preferred location or to create a more uniform light throughout the flexible panel.

Figure 28:
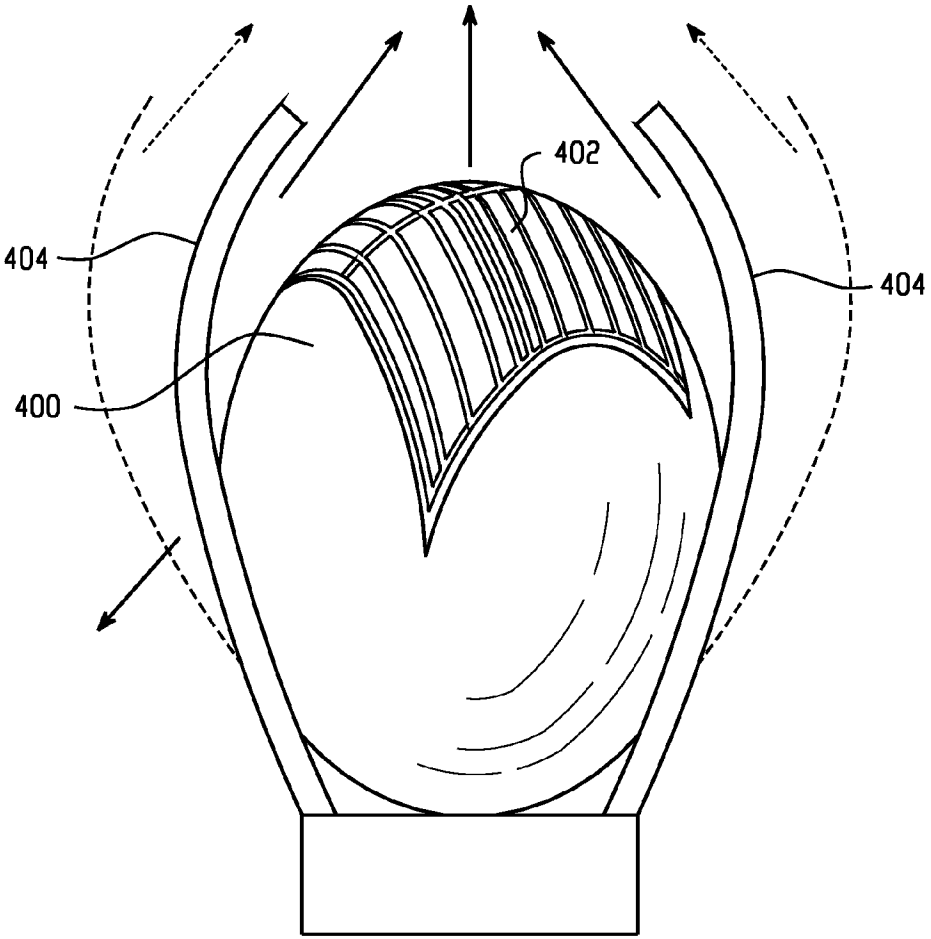
FIG. 28 illustrates the luminaire of FIG. 27 with an adjustable reflector.
Figure 27:
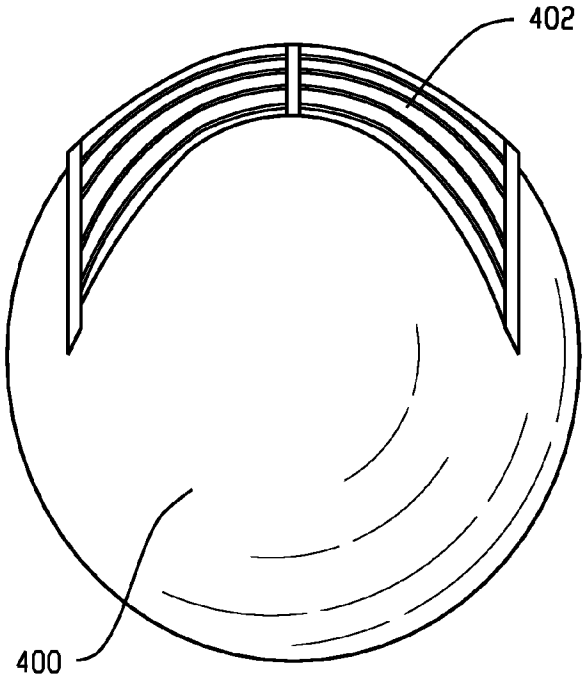
FIG. 27 shows a flexible OLED panel disposed on a spherical-shaped surface.

In FIG. 27, a generally spherical-shaped surface 400 receives a flexible OLED panel 402 on a portion thereof. This illustrates that the OLED panel is generally flexible in more than one direction. Further, the spherical-shaped surface 400 may be selectively altered (FIG. 28) to change the light output from the panel. In addition, a selectively variable reflector surface(s) 404 may likewise be altered by changing the spherical-shaped surface 400 or by using an alternative mechanism to vary the shape of the surface. It is also contemplated that the spherical-shaped support surface 400 could be actively varied via a remote control.

The disclosure has been described with respect to preferred embodiments. Obviously, modifications, alterations, and associated benefits may be contemplated by one skilled in the art. For example, although the proposed solutions find particular use in large area OLED devices that use electrical feed-through openings, selected aspects may also find application in OLED devices in general. Structural material for the flexible luminaire can be a thin ductile metal, polymeric or elastomeric material. Alternatively, the structural material may be aplastic composite, i.e. a metal/carbon reinforced polymer composite having sufficient thermal conductivity (>1 W/mk) to ensure heat dissipation of large panel luminaires. Preferred carbon can be carbon nanotube, graphene, graphene oxide or graphite with up to 50% filling. Typical metal can be Al, Sn, and Ni, etc. The subject disclosure should not be limited to the particular examples described above but instead through the following claims.

What is claimed is:

1. A luminaire comprising:

an elongated flexible surface;

a solid state light emitting device mounted to the surface, the light emitting device including at least first and second panel portions, the first panel portion being conformable; and a conforming mechanism for curving at least one of the first and second panel portions of the elongated flexible surface, the conforming mechanism includes first and second arms extending from a central region, the arms secured at distal ends to the flexible surface and selectively urged toward and away from one another to alter a curvature of the flexible surface.

2. The luminaire of claim 1 wherein the conforming mechanism selectively curves the first panel portion into one of a planar conformation or an arcuate conformation.

3. The luminaire of claim 1 wherein the conforming mechanism selectively curves the first panel portion from a first arcuate conformation to a second arcuate conformation having a greater degree of curvature than the first arcuate conformation.

4. The luminaire of claim 1 wherein one of the first and second solid state light emitting devices includes a light emitting diode (LED).

5. The luminaire of claim 4 wherein the LED includes multiple LEDs in the first panel portion enclosed by a translucent housing.

6. The luminaire of claim 1 wherein the first panel portion is conformed relative to the second panel portion.

7. The luminaire of claim 1 further comprising a thin diffuser overlying at least a portion of the first panel portion for directing light from an edge thereof.

8. The luminaire of claim 1 wherein the first and second solid state light emitting devices are organic light emitting devices (OLED).

9. The luminaire of claim 1 wherein the conforming mechanism includes a threaded member for selectively altering a curvature of the first light emitting device.

10. The luminaire of claim 1 further comprising a generally spherical-shaped support for the first panel portion.

11. The luminaire of claim 10 wherein the first color panel portion is centrally positioned between second panel portions disposed on either side thereof.

12. The luminaire of claim 11 wherein the first color panel portion emits blue light, and the second panel portions emit yellow light.

13. A luminaire comprising:

a flexible surface;

an organic light emitting device (OLED) mounted to the surface being conformable;

at least one member supporting a first portion of the flexible surface; and an adjustable member supporting a second portion of the flexible surface and selectively moving the second portion relative to the first portion and imparting a curvature to the OLED wherein the adjustable member selectively advances and retracts the flexible surface through positive and negative curvatures.

14. The luminaire of claim 13 wherein the OLED is powered by a battery.

15. The luminaire of claim 13 wherein the adjustable member being positioned in a central region of the flexible surface.

16. The luminaire of claim 15 wherein at least one member includes multiple supports for mounting a perimeter of the OLED.

17. The luminaire of claim 15 wherein the flexible surface is an umbrella in which OLED portions are mounted on interior panels thereof.

18. The luminaire of claim 13 wherein the flexible surface has a predetermined non-planar conformation, and the at least one member and the adjustable member are pivotally connected in a generally x-shaped configuration.

19. A luminaire comprising:

at least first and second OLED devices, the first OLED device having a color temperature ranging from about 2500K to about 3500K and the second OLED device having a color temperature of about 5000K or greater; and a DC driver for driving the OLEDs and maximizing control of optical intensity light distribution and color mixing;

wherein the power is less than about 4 watts.

20. The luminaire of claim 19 wherein the power is less than about 1 watt per OLED device.

21. The luminaire of claim 19 wherein the one of the first and second OLED devices is a blue light and the other of the first and second OLED devices is a yellow light.

22. The luminaire of claim 19 wherein the DC driver drives the OLED devices in series.

23. The luminaire of claim 19 further comprising controlling color by regulating power of a blue OLED.

24. The luminaire of claim 19 wherein the color temperature ranges from approximately 3500K to about 6200K.

25. The luminaire of claim 19 wherein the power applied is >20 $mw/in^2$.

* * * * *